US005667855A

United States Patent [19]

Borden et al.

[11] Patent Number: 5,667,855

[45] Date of Patent: Sep. 16, 1997

[54] REUSABLE TEAR THROUGH BANNER

[76] Inventors: Timothy W. Borden, Rte. 5, Box 606; Daniel D. Yates, Rte. 5, Box 612, both of Jasper, Ala. 35501

[21] Appl. No.: 654,253

[22] Filed: May 28, 1996

[51] Int. Cl.[6] ..... G09F 17/00

[52] U.S. Cl. ..... 428/8; 428/100; 428/99; 428/57; 40/604

[58] Field of Search ..... 428/100, 8, 99, 428/57; 40/603, 604

[56] References Cited

U.S. PATENT DOCUMENTS 4,631,765 12/1986 Casey ..... 428/99
4,906,503 3/1990 De La Cruz et al. ..... 428/81

*Primary Examiner*—Alexander Thomas
*Attorney, Agent, or Firm*—Wm. Randall May

[57] ABSTRACT

A reusable, "tear-through" display banner is disclosed. The banner consists of fabric or a flexible sheet of material having multiple portions capable of being assembled into a unitary banner by the use of a releasable fastening means along the portion edges.

3 Claims, 3 Drawing Sheets

REUSABLE TEAR THROUGH BANNER

BACKGROUND OF THE INVENTION

This invention relates generally to display banners and more specifically to reusable banners primarily for use at spectator and audience events such as athletic games and other entertainment and specialized venues.

Display banners are frequently and routinely used by institutions such as intermediate schools, high schools, colleges and universities typically in connection with sports related activities of the institution. However, display banners are also used for non-sports related events such as academic competitions, fund raising events and other similar events sanctioned or sponsored by such institutions. Banners are also used by many semi-professional and professional sports teams. Display banners, especially tear-through banners for school sponsored sporting events, are often used at pep rallies, games and fund raisers for such sports as football, soccer, basketball, baseball, softball, volleyball and wrestling. Traditionally, team supporters such as cheerleaders, members of fan clubs or other support groups will design and produce paper banners with the team institution name and/or logo imprinted thereon. Such banners are used to identify the particular institution or team to the viewing audience and are typically prepared for the team members representing the institution to run through at the beginning of a sporting event as the team players are introduced to the spectators.

A typical tear-through paper banner takes approximately 3 to 4 hours to design and produce and can involve as many as 8–10 individuals working on the banner. Once used, the tear-through banner cannot be used again and is thereafter discarded or recycled as scrap paper. Many schools, colleges and universities have multiple sports activities and, depending on the season, may have the need for such display banners several times per week. The cost of materials and the time required to design and produce these disposable banners can thus be quite significant. It would be expedient, therefore, for the provision of a durable, resilient, reusable, tear-through display banner as taught and claimed by the present applicant.

SUMMARY OF THE INVENTION

In view of the foregoing, it is a primary object of this invention to provide a reusable, tear-through display banner having a plurality of portions capable of being assembled and reassembled into a unitary banner.

According to an embodiment of the invention, a reusable display banner comprises a fabric or plastic sheet bearing a logo or other indicia and consists of multiple portions capable of being assembled into a unitary banner by means of releasable fastening means along the portion edges so that one or more persons can "tear-through" the assembled banner after which the banner can be reassembled for subsequent use.

An advantage of the present invention is the provision of a durable, reusable, "tear-through" display banner the use and reuse of which is cost effective, thereby saving a tremendous amount of time, energy and expense over existing disposable banners.

Another advantage of the present invention is the provision of a reusable, "tear-through" display banner which is resilient and durable yet inexpensive to manufacture.

Another advantage of the present invention is the permanent design of the device which, with proper care, could be used and reused virtually indefinitely.

A further advantage of the present invention is the use of its releasable fastening means which allows the device to be repeatedly "torn-through" and quickly reassembled without damage to the banner.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
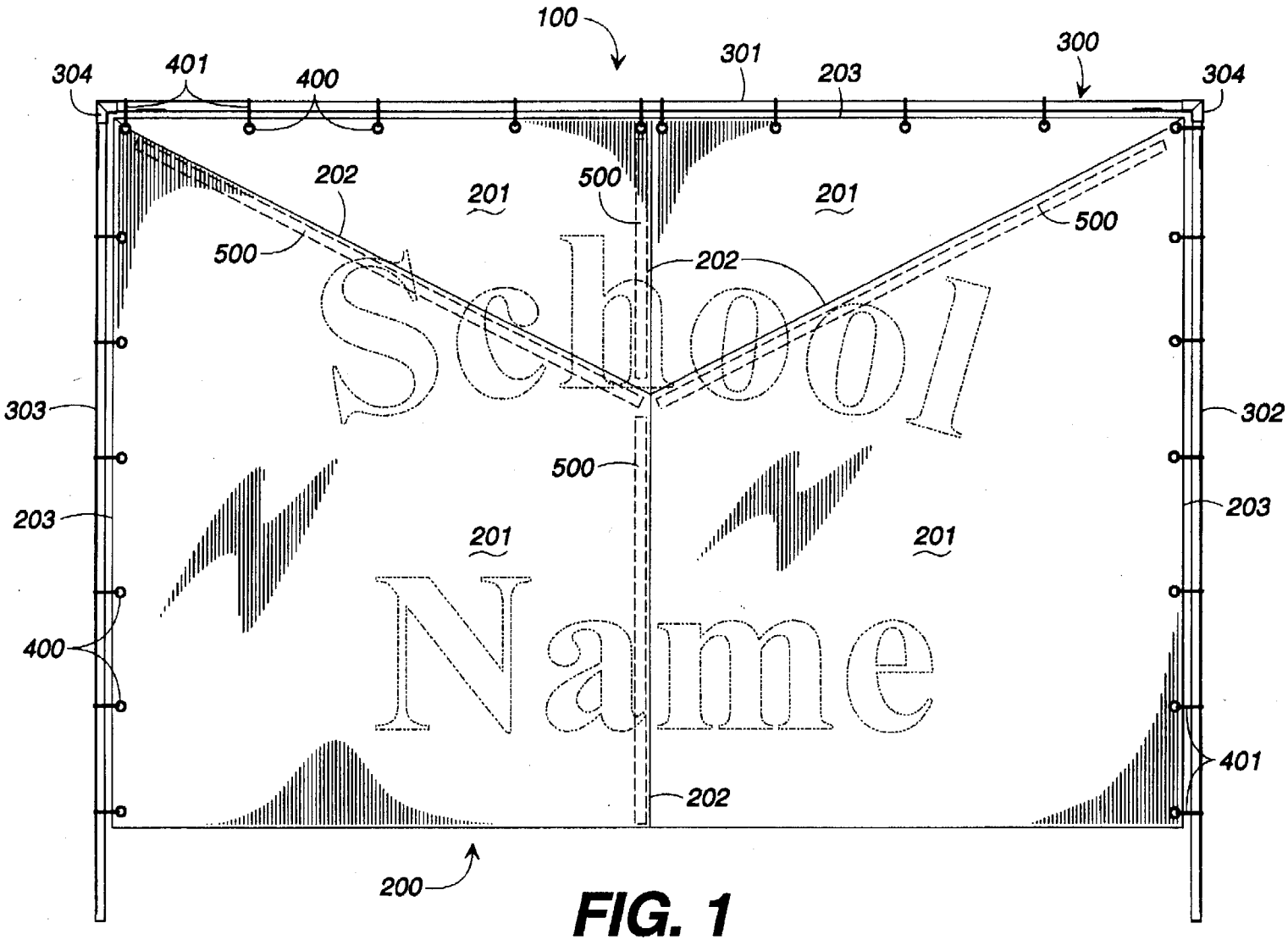
FIG. 1 is a front view of an embodiment of the invention shown fully assembled.

In accordance with an embodiment of the invention, FIG. 1 shows a reusable, "tear-through" display banner 100. The banner 100 of FIG. 1 comprises a fabric or flexible plastic sheet 200 typically bearing the logo or other indicia of an institution or organization. Said sheet 200 further comprises a plurality of portions 201 capable of being assembled into a unitary banner 100 by means of releasable fastening means 500.

Figure 3:
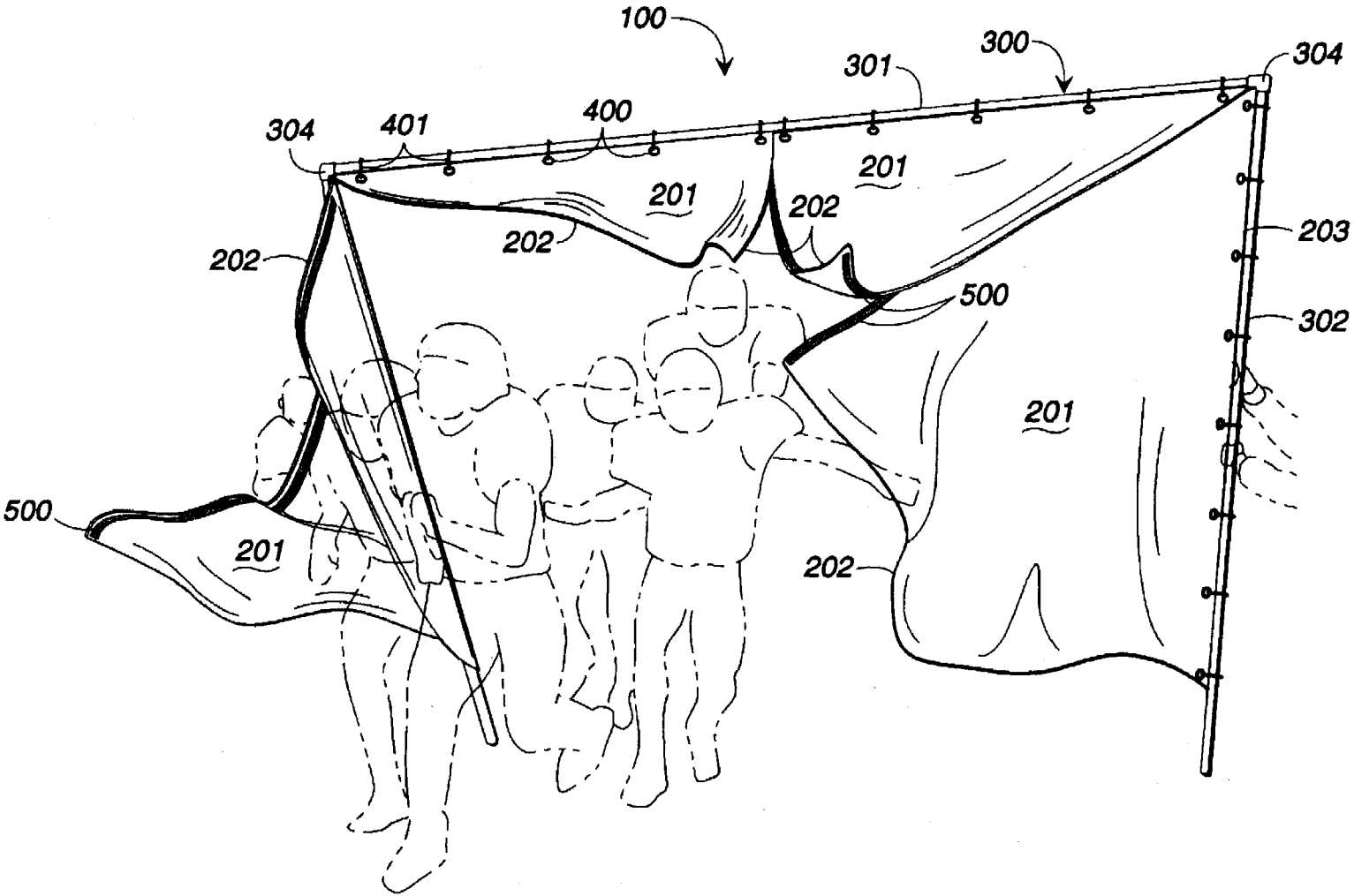

Each portion 201 comprises two or more inner edges 202 and at least one outer edge 203. As best seen in FIG. 3, the inner edges 202 of adjacent portions 201 overlap slightly and are provided with releasable fastening means 500, such as velcro-type hook and loop fastening means, attached along opposing sides of said overlapping inner edges 202. The attachment of said fastening means 500 in said manner allows the overlapping inner edges 202 of adjacent portions 201 of said banner 100 to be releaseably and smoothly fastened together so as to give the appearance of a unitary sheet or banner. The use of the releasable fastening means 500 also allows the portions 201 of the banner 100 to be quickly and easily reassembled into a unitary piece for repeated event usage.

Figure 2:
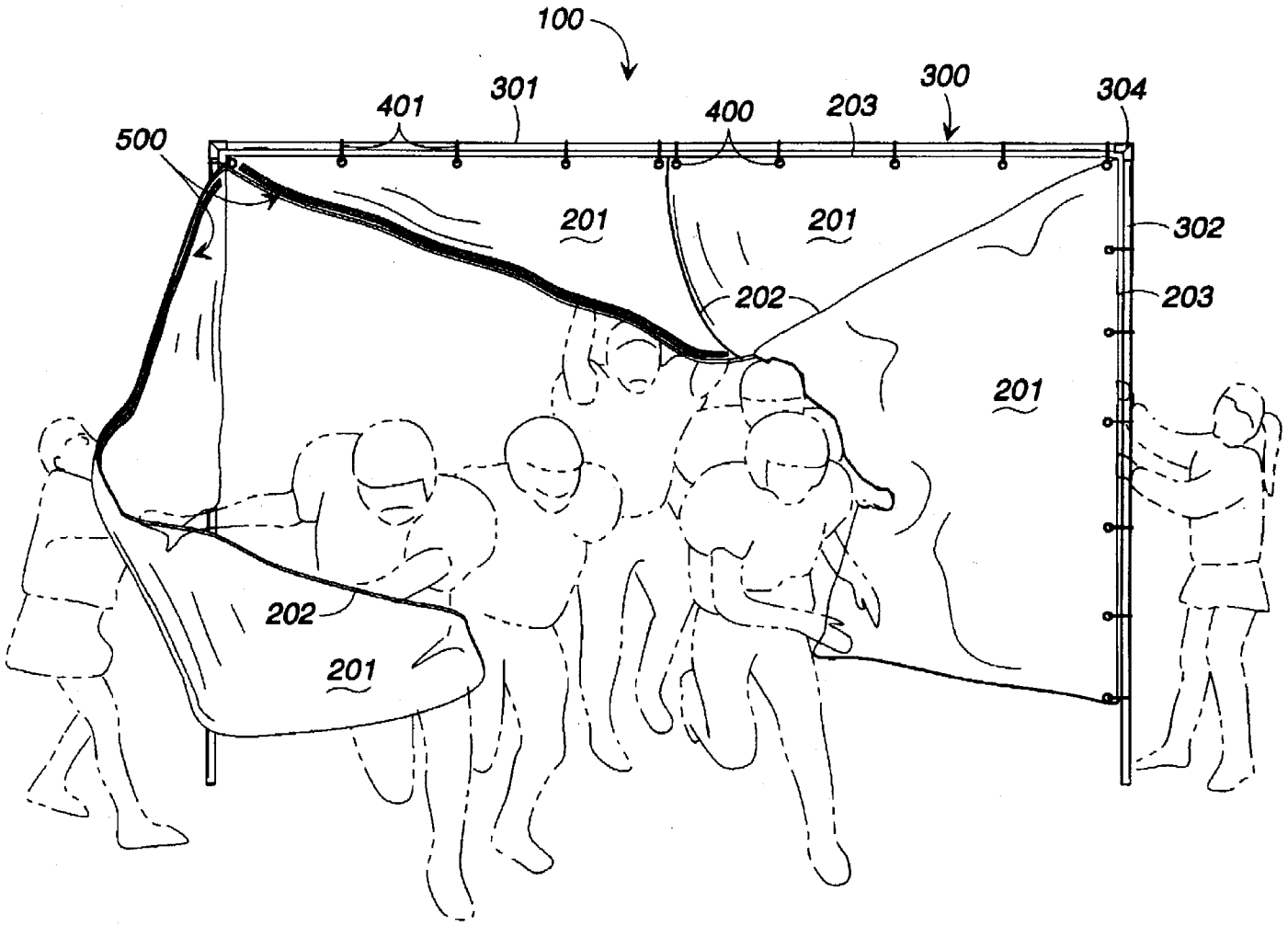
FIGS. 2–3 are sequential views of the invention as the invention is being "torn-through" by a team of athletes.

The outer edges 203 of the portions 201 forming the sides and top of the banner 100 are provided with a plurality of attachment holes 400 so that the fully assembled banner 100 can be attached to an appropriately sized "A"-shaped frame 300 as shown. Said "A"-shaped frame 300 is rigid and comprises a top member 301 and two side members 302. One end of each side member 302 is securely attached to one end of said top member 301 by means of an "L" coupling 304 as shown. The banner 100 is securely attached, through the use of a plurality of attaching means 401, at holes 400, to the top member 301 and to and between the side members 301 of said frame 300. Attachment of the banner 100 to said frame 300 in such manner allows the banner 100 to be stood vertically or to be held vertically in place by two or more people for display. The top and side members 301 and 302 also allow the banner 100 to be held firmly in place as others "bust" or "tear" through the releasable portions 201 of banner 100 as shown in sequential FIGS. 2–3.

It should be noted that the geometric shape or cut of the portions 201 comprising the unitary sheet 200 is virtually unlimited thereby allowing the banner 100 to be produced with any number or design of splits or breaks.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A reusable, "tear-through" display banner comprising:

a flexible sheet having, a plurality of sections, each section having one or more inner edges and one or more outer edges wherein the inner edges of adjacent sections overlap, and, releasable fastening means attached to the opposing overlapping inner edges of said sections whereby said sections may be releasably assembled into a unitary banner; and, a frame bordering two or more sides of said sheet and attached to the outer edges of said sections of said sheet.

2. A reusable "tear-through" display banner according to the product of claim 1 produced by a process comprising the steps of:

dividing a flexible sheet of material into a plurality of sections, whereby each section has at least one inner edge and one outer edge and whereas the inner edges of adjacent sections overlap;

attaching a releasable fastening means to the opposing overlapping inner edges of said sections; and, attaching the outer edges of two or more sides of said banner to a frame.

3. The product of claim 2, wherein the process of producing said reusable, "tear-through" banner further comprises the placement of a plurality of attachment holes along the outer edges of said sections.

* * * * *